US005598788A

United States Patent [19]

Jonker

[11] Patent Number: 5,598,788

[45] Date of Patent: Feb. 4, 1997

[54] VERTICALLY ADJUSTABLE TABLE

[75] Inventor: Kurt A. Jonker, Grand Rapids, Mich.

[73] Assignee: Knoll, Inc., East Greenville, Pa.

[21] Appl. No.: 348,410

[22] Filed: Dec. 2, 1994

[51] Int. Cl.[6] ..... A47B 9/00

[52] U.S. Cl. ..... 108/147; 108/144; 248/631

[58] Field of Search ..... 108/147, 144, 108/106; 248/407, 408, 631

[56] References Cited

U.S. PATENT DOCUMENTS

| | | | |
|---|---|---|---|
| 2,405,013 | 7/1946 | Campbell | 248/408 |
| 3,179,071 | 4/1965 | Johnston | 248/407 X |
| 3,325,136 | 6/1967 | Radke et al. | 248/631 X |
| 3,642,320 | 2/1972 | Ward | 248/407 X |
| 3,708,203 | 1/1973 | Barecki et al. | 248/408 X |
| 4,266,306 | 5/1981 | Lee | 248/408 X |
| 4,546,668 | 10/1985 | Mattsson | 248/408 X |
| 4,747,353 | 5/1988 | Watt | 108/144 X |
| 5,289,782 | 3/1994 | Rizzi et al. | 108/147 |
| 5,311,827 | 5/1994 | Greene | 108/147 |
| 5,400,721 | 3/1995 | Greene | 108/147 |

FOREIGN PATENT DOCUMENTS

| | | | |
|---|---|---|---|
| 880934 | 4/1943 | France | 108/144 |

*Primary Examiner*—Peter M. Cuomo
*Assistant Examiner*—Janet M. Wilkens
*Attorney, Agent, or Firm*—Buchanan Ingersoll, P.C.; Carla J. Vrsansky

[57] ABSTRACT

A vertically adjustable desk, table or workstation has a work surface carried between a pair of leg assemblies. The leg assemblies have telescoping sleeves and a ratcheting latch mechanism operatively interconnecting the sleeves. The ratcheting latch mechanism has a toggle preferably in the inner sleeve and a ratchet opening, preferably in the outer sleeve. The opening is defined in part by an edge formed with a series of lateral inclined ratchet slots at which a latch pin on the toggle can set the vertical height. The toggle is spring biased to either of two over-center alignments. Upper and lower edges of the opening respectively toggle the latch mechanism to move the pin out of engagement with the slots at the top limit of travel, and back into engagement with the slots at the bottom limit of travel. The latch pin follows the ratchet slots in progression as the table is raised, and is switched by the top and bottom edge portions to disengage or engage the slots. Gas springs optionally may be included to produce an upward balancing force for supporting the work surface.

13 Claims, 4 Drawing Sheets

VERTICALLY ADJUSTABLE TABLE

BACKGROUND OF THE INVENTION

1. Field of the Invention

This invention relates to a table or workstation having a work surface and means to adjust the vertical height of the work surface, to accommodate the needs and comfort of the user.

2. Prior Art

The recent widespread use of computer terminals in many offices and industries has let to a number of health and comfort complaints by workers. Most computer terminals are placed on conventional non-adjustable desk or workstation surfaces at a predetermined standard height. This height may or may not be optimal for a given worker. The worker normally cannot adjust the work surface to place the keyboard or display monitor of the computer terminal at a vertical height that is more convenient and comfortable.

It is known to employ supplemental apparatus to support a keyboard or monitor on a desk, table, counter or the like, at a height which is different than that of the desk surface. It is typically comfortable to place the keyboard lower than the desk surface. The display monitor can be raised above the desk surface. However, where the terminal or the like is to be supported on the desk surface without such supplemental apparatus, the worker must make do with the work surface height. This can be uncomfortable because the "standard" height of a desk is optimal for writing rather than for typing. Workers may have to arch their bodies or hold their arms at an elevated position, to operate a keyboard on the work surface.

Of course, a particular work surface may be lower than standard or the worker may by tall or have a relatively high chair. In that case, the worker must hunch over to operate the keyboard and/or view the display monitor. As a result, conventional, non-adjustable desks and workstations are not comfortable for workers operating computer terminals, and in some cases have led to health related problems, for example back strain, repetitive motion injuries such as carpal tunnel syndrome and the like.

What is needed is a convenient and durable arrangement for varying the vertical height of a work surface. Preferably, the height should be adjustable over a range sufficient to encompass users' needs for keyboard support or writing, and to encompass such a range for users of different sizes or users having different chair heights. Moreover, when fixed in position, the work surface must be solidly fixed and immovable.

Desks, tables and workstations having a vertically adjustable work surface are known, for example of the type designed for draftspersons who may wish to work either when sitting or a standing. However, many known vertical adjustment devices for desks, tables and workstations are difficult to adjust and may require more than one person to support the work surface while making vertical adjustments, particularly if a computer monitor or some other heavy but relatively fragile load is on the surface.

The procedure may involve manual unlatching of a mechanism, which detaches the vertical supporting structure, and re-latching the mechanism at a different height. Alternatively, a cranking mechanism may be involved. These devices occupy one of the user's hands. It can be awkward to operate such a mechanism with one hand, even assuming a counterweight or balance is included, and to attempt to support or guide the work surface with the other hand. Many users choose simply to forego adjusting the table because they would rather inconvenience themselves with an improperly adjusted table than accomplish the necessary adjustments.

What is needed is an improved vertically adjustable table mechanism that simplifies the procedure of vertical adjustment, that can be accomplished by a single user without awkward movements, and that provides a stable and secure support surface.

SUMMARY OF THE INVENTION

It is therefore an object of this invention to provide a table or workstation having a vertically adjustable work surface that can be easily adjusted by a single user.

It is another object of this invention to provide a table or workstation having a vertically adjustable work surface that is capable of supporting heavy computer terminals and related equipment.

It is also an object to provide a mechanism that can be confidently adjusted while a computer terminal or the like is supported on the table.

It is another object of this invention to provide a table or workstation having a vertically adjustable work surface that is reliable, stable, and simple to adjust to a number of different vertical positions.

These and other aspects and objects are provided according to the invention in a vertically adjustable table or workstation comprising a pair of vertically adjustable leg assemblies supporting a work surface. Each of the vertically adjustable leg assemblies comprises a stationary lower sleeve, preferably the outer one of two telescoping sleeves, with a lower end terminating in a foot member. An inner sleeve is slidable in the outer one and has an upper end terminating in a bracket. Vertically sliding the inner sleeve and the attached work surface, relative to the outer sleeve, adjusts the work surface up and down relative to the stationary foot members on the floor, over a range between upper and lower limits.

Each leg assembly further includes an adjustment assembly which comprises the combination of a gas spring and a ratcheting latch mechanism having two stable arrangement between which the latch mechanism is switched upon reaching the upper and lower limits, respectively. The gas spring has one end attached relative to the foot member and an opposite upper end affixed to the inner sleeve. During vertical adjustment of the table the gas springs produce a reactionary force in opposition to the movement of the work surface to thereby dampen or brake the motion of the work surface. The gas springs of the two legs optionally may be pre-charged to produce an upward balancing force capable of offsetting at least part of the weight of the work surface and any load thereon.

The ratcheting latch mechanism adjustably interconnects between the bracket and the foot member such that the work surface is adjustable upwardly to any of a series of discrete vertical steps, and is adjustable downwardly in one step. The ratcheting latch mechanism preferably comprises a toggle enclosed in the inner sleeve, for example having two pivoted link members coupled by a tension spring urging the link members between over-center positions.

The outer sleeve is formed with an opening defining a series of ratchet slots. The toggle has opposite ends and is arranged to carry a latch pin disposed to occupy any of the series of ratchet slots in ascending progression to provide vertical adjustment capability. The toggle urges the latch pin toward the ratchet slots, which are inclined so that the latch pin can be lowered to bottom out in a selected slot, or raised to engage in the next higher slot.

The ratchet opening in the outer sleeve has two operative edge portions in addition to the edge portion with the ratchet slots. These function at the limits of travel to switch the ratchet mechanism between an engaging state and a disengaging state. The edge portions are aligned such that latch pin follows the edge portions during relative vertical movement between the inner and outer sleeves. The two edge portions at the limits of travel are inclined such that, as the latch pin follows along them, the toggle is induced to snap into the disengaging state by the upper edge portion and into the engaging state by the lower edge portion.

The latch pin engages with the ratchet slots during lifting, and can be set at any selected slot to fix the work surface height. The latch pin is switched to the disengaging state at the upper limit. When the surface is then lowered to the lower limit the latch pin is switched back toward engagement with the ratchet slots. The latch pin can be placed in any one of the ratchet slots as the work surface is lifted. By lifting the work surface to its upward end position to toggle the latch, the work surface can be lowered to its lower end position with the latch pin held out of engagement with the slots. The lower surface toggles the latch pin back into the engagement state and the process can be repeated.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
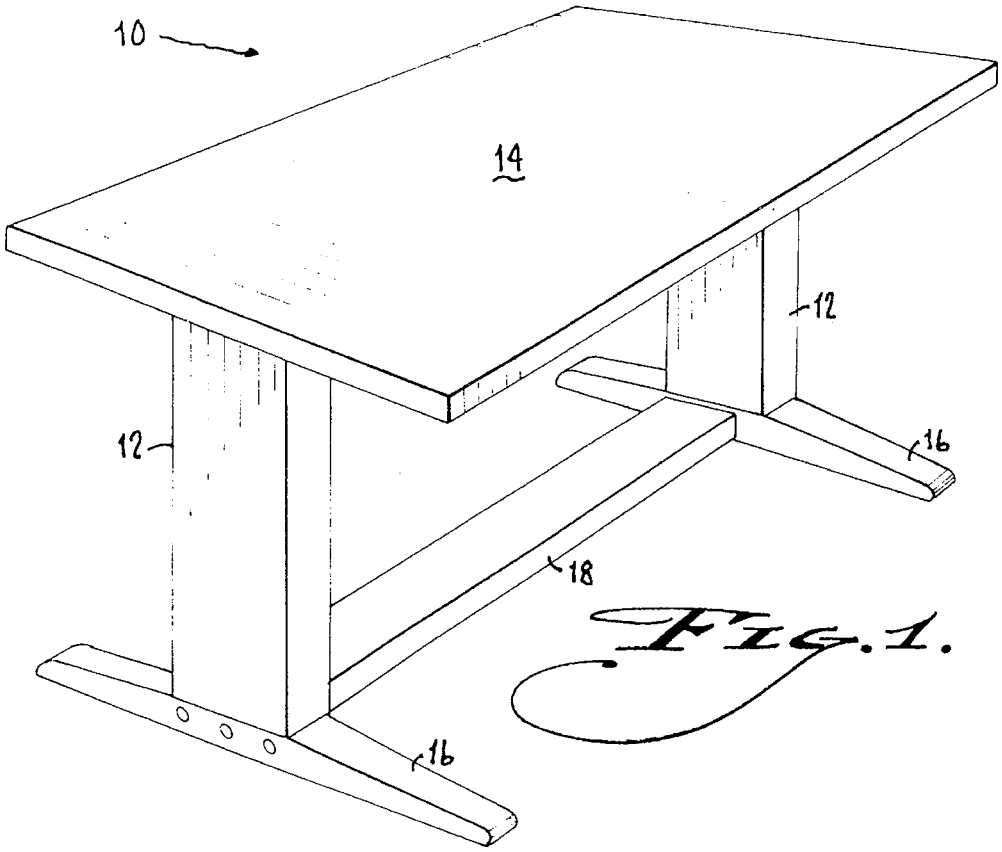
FIG. 1 is a perspective view of a vertically adjustable table or workstation in accordance with the invention.

In FIGS. 1, a vertically adjustable table or workstation 10 in accordance with the invention comprises left and right leg assemblies 12 arranged to carry a work surface 14 in various stable, vertically adjusted positions above a floor. Each leg assembly 12 has a lower end terminating in an enlarged foot 16 which may be provided at opposite forward and rearward ends with threaded levelers (not shown) to permit the work surface 14 to be leveled on an uneven floor. The work surface 14 is shown aligned substantially in a horizontal plane for convenience of this description only; however, the work surface 14 also could be aligned at a desired angle of inclination, and inclination itself can be independently adjustable.

Figure 2:
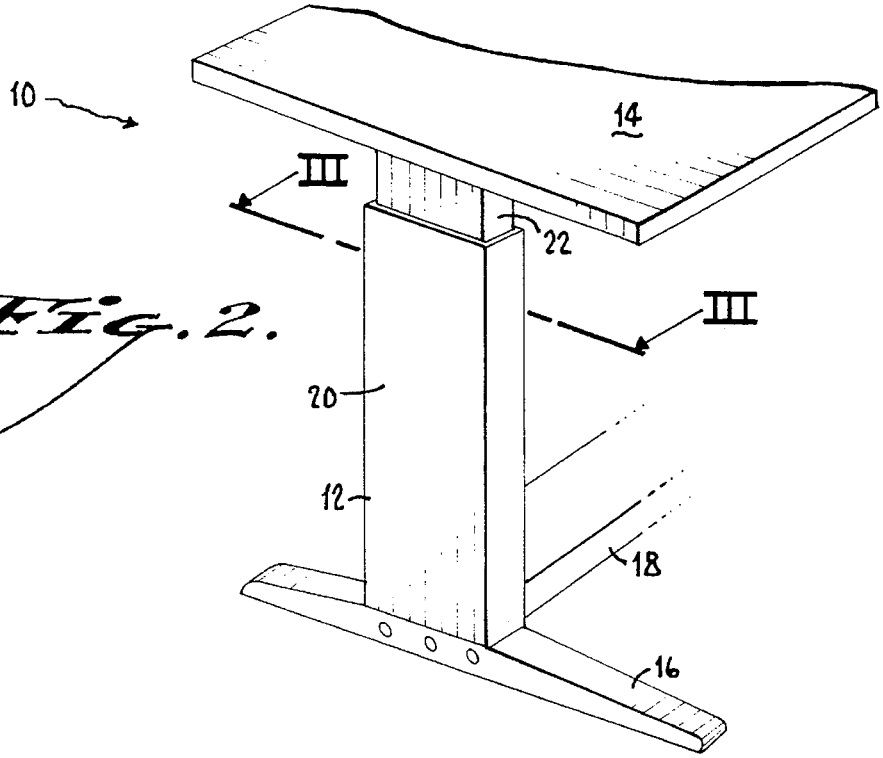
FIG. 2 is a partly broken away perspective view thereof except that the table has been adjusted relatively upward as compared to FIG. 1.
Figure 3:
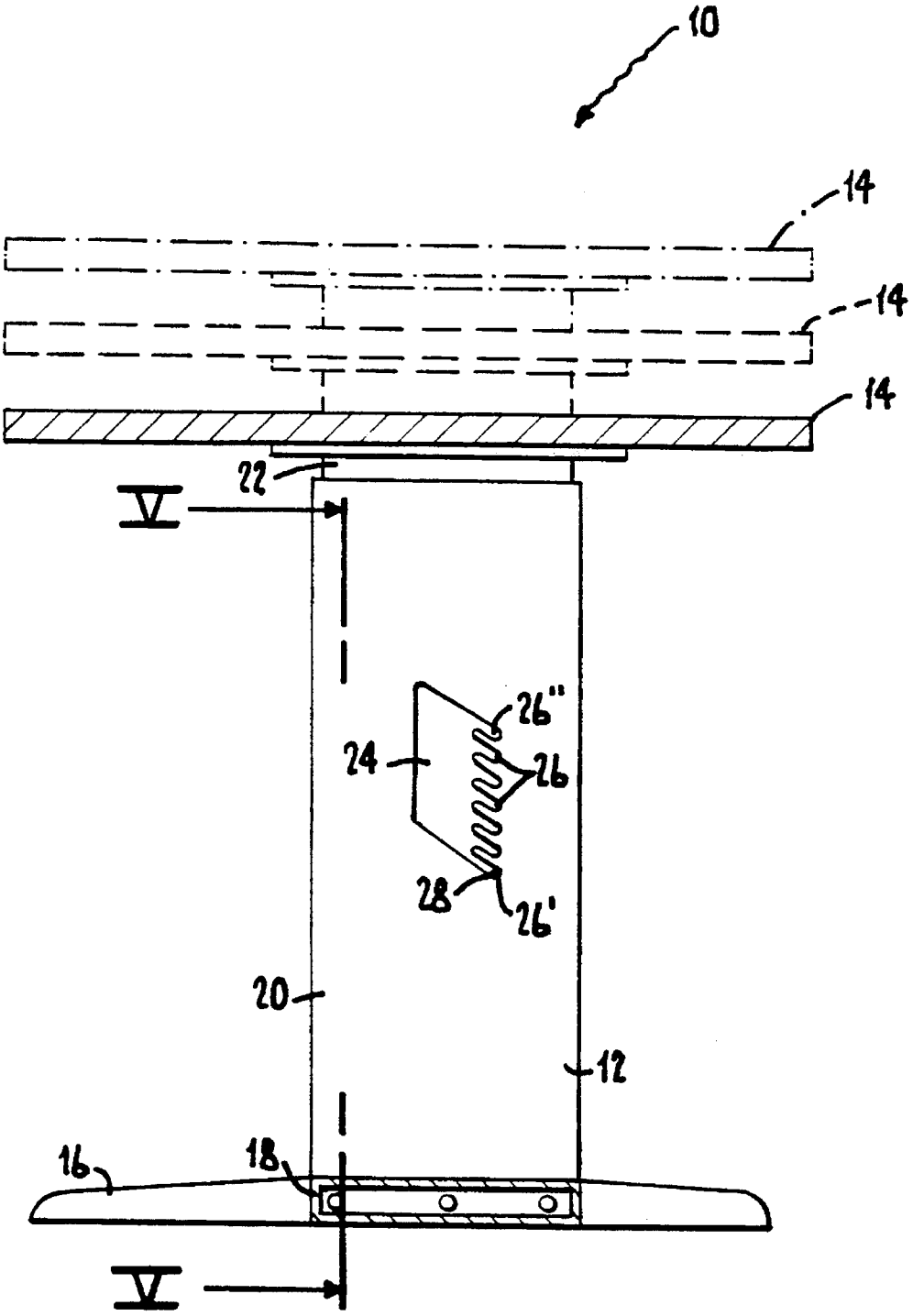
FIG. 3 is a section view taken along line III—III in FIG. 2, including broken line depictions of the table as set at various vertical positions.

The two feet 16 preferably are rigidly interconnected by a cross bar 18 that stabilizes the feet by fixing them together. As shown by FIGS. 2 and 3, extending upwardly from each foot 16 is an elongated rectangular sleeve 20, preferably a substantially hollow outer sleeve that receives a complementary elongated rectangular inner sleeve 22, in a telescoping manner. In FIG. 3, the outer sleeve 20 has an inner sidewall formed with a toothed opening 24. The toothed opening 24 has a right edge defining a series of inclined ratchet slots 26 of which there are seven in the embodiment shown, at spaced vertical positions between a lowermost slot 26' and an uppermost slot 26". The lowermost inclined ratchet slot 26' is shown occupied by a latch pin 28 that is associated with a toggle, described below, carried in inner sleeve 22.

In FIG. 3, broken lines show the work surface 14 in various vertically adjusted positions, and the latch pin 28 is correspondingly shown occupying progressively higher ones of the inclined ratchet slots 26. As will be described, the given position of the latch pin 28 in a chosen one of the inclined ratchet slots 26 determines the vertically adjusted position of the work surface 14. When positioned at a desired slot, the latch pin 28 is urged laterally into the slot, such that the work surface can be lowered slightly as the latch pin bottoms out in the slot to fix the vertical position of the work surface.

Figure 5:
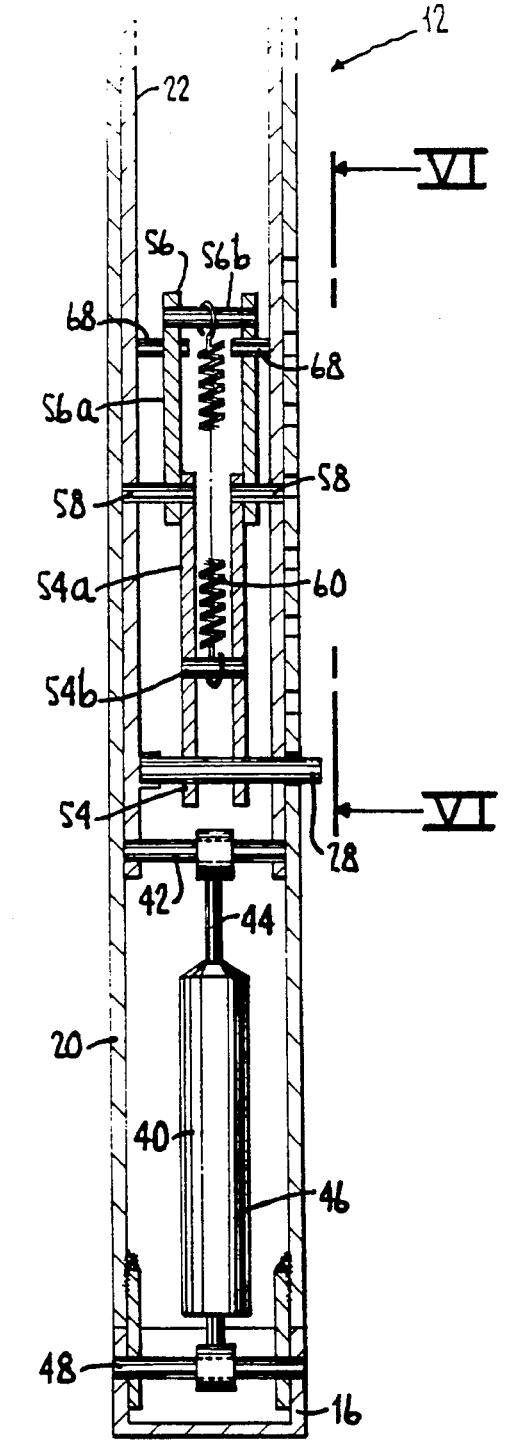
FIG. 5 is an enlarged section view taken along line V—V in FIG. 3.

FIG. 5 shows the left leg assembly 12 in a disassembled state. Each one of the inner and outer sleeves 22 and 20 is formed of four planar sidewalls defining a generally rectangular axial conduit. The sleeves 20, 22 can be made of extruded aluminum or from any other suitable material formable in the desired shape. Although the lower sleeve is the female member in this embodiment, it is also possible to reverse the gender of the upper and lower sleeves.

The inner sleeve 22 extends vertically between a lower open end 30 and an upper open end 32, which upper end 32 is attached to a bracket 34 that is attachable to the underside of the work surface 14. The outer sleeve 20 extends vertically between an upper open end 36 and a formed lower end 38 that is shaped for insertion in a complementary receptacle in the foot 16 for fastening together. The inner sleeve 22 is sized for close fitting insertion in the outer sleeve 20 by insertion through the open upper end 36, and the rectangular shapes of the sleeves is such that the upper sleeve is guided in the lower one.

The inner sleeve 22 carries an air spring 40 by a pin 42 extending through an eye loop on an end of the piston rod 44 of the air spring 40. The pin 42 is fixed in the inner sleeve 22 adjacent the lower end 30, and the eye loop 44 is permitted to pivot on the pin 42. The air spring 40 includes a piston cylinder 46 in which a piston (not shown) connected to the piston rod 44 reciprocates in known manner. The piston cylinder 46 has a lower end formed with an eye loop for insertion of a bolt 48 that also connects together the foot 16 and outer sleeve 20.

The air spring 40 acts to counter force applied to the piston rod 44. Thus, the air spring 40 acts to brake or resist any force applied through the piston rod 44, regardless whether the direction of the applied force acts to drive the piston rod 44 in extension or retraction. The air spring can be preloaded to offset part of the weight of the table and any load thereon.

Figure 6:
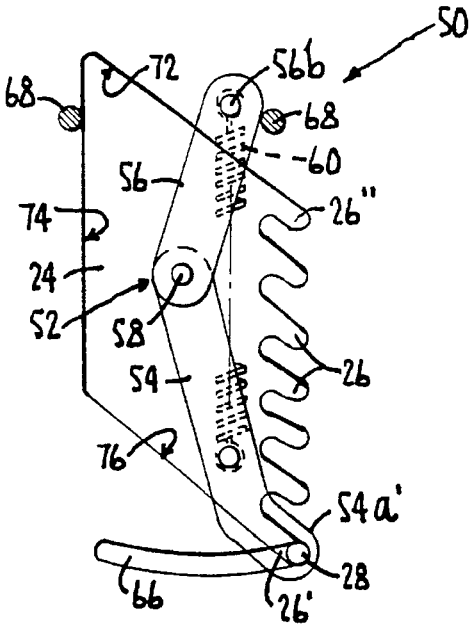
FIG. 6 is a diagrammatic elevational view taken in the direction of arrows VI—VI in FIG. 5, depicting the components of a ratcheting latch mechanism as shown in isolation as positioned for engagement with the ratchet slots; and, FIG. 7 corresponds to FIG. 6 except that a toggle of the ratcheting latch mechanism has snapped over-center to the disengaged state.
Figure 7:
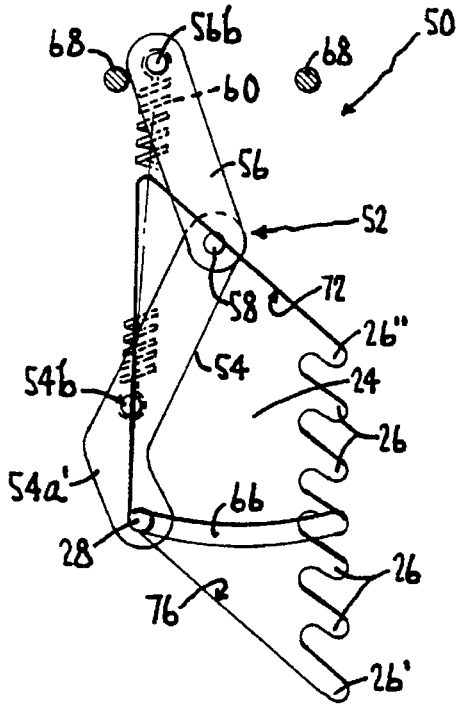

An inventive aspect of the vertically adjustable table 10 relates to a ratcheting latch mechanism 50, which consists essentially of a toggle 52 disposed inside the inner sleeve 22 and the toothed opening 24 in the outer sleeve 20. As shown in FIGS. 5–7, the toggle 52 comprises a U-shaped lower yoke 54 and an inverted-U shaped upper yoke 56 commonly pivoted to a pair of spaced studs 58 protruding oppositely from spaced sidewalls of the inner sleeve 22. The studs 58 define a pivot axis for the yokes 54 and 56, and this pivot axis is fixed relative to the inner sleeve 22.

The upper yoke 56 includes a bight **56*b* spacing apart opposite arms 56*a* of the upper yoke 56. The lower yoke 54 likewise includes a bight 54*b* spacing apart opposite arms 54*a* of the lower yoke 54. The yokes 54 and 56 are biased by a coil tension spring 60 that occupies a gap between the spaced arms 54*a* and 54*b* of the yokes 54 and 56. The coil tension spring 60 has opposite, upper and lower hook ends hooked on the bights 56*b* and 54*b* of the upper and lower yokes 56 and 54, respectively, and by pulling inwardly urges the upper and lower yokes 56, 54 to assume one or the other of the relative positions shown in FIGS. 6 and 7**.

Figure 4:
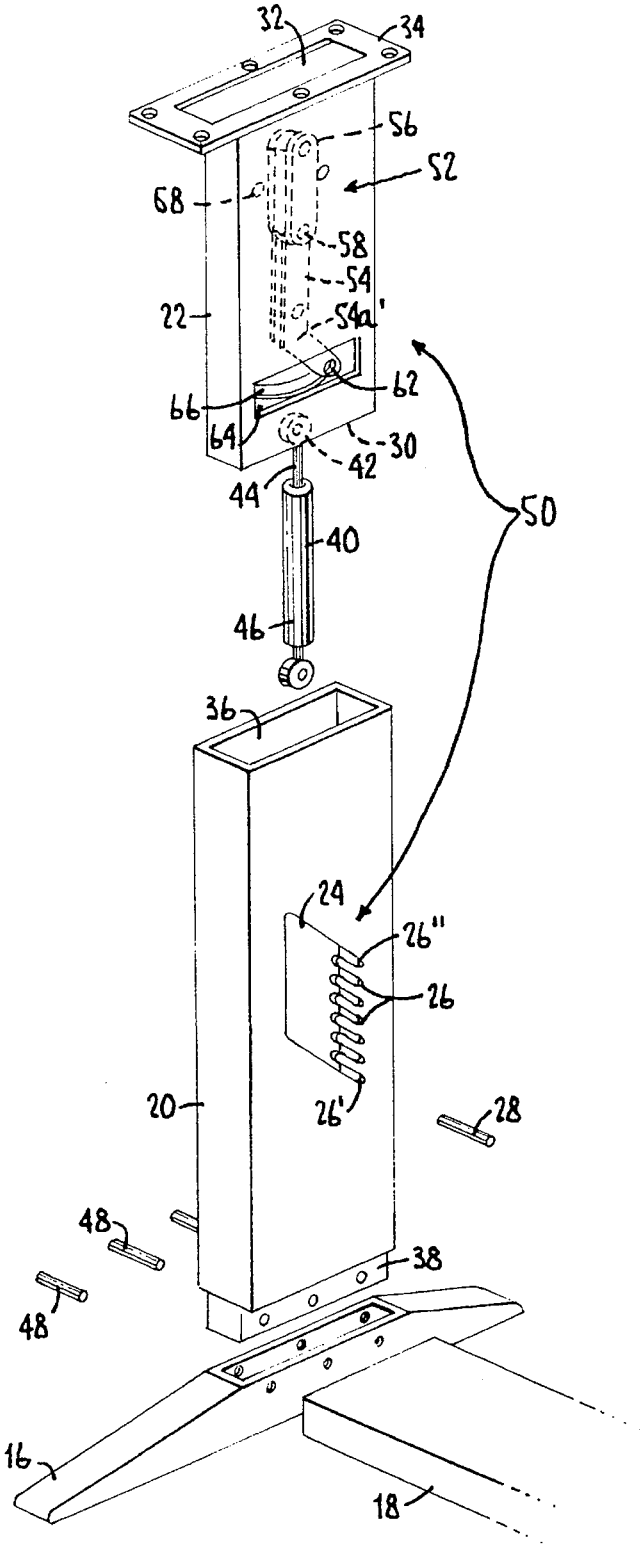
FIG. 4 is an exploded perspective view of the table leg in FIG. 3.

FIG. 4 shows the inner sleeve 22 in a pre-assembly condition wherein, among other things, the coil tension spring 60 is absent from the toggle 52. The lower yoke 54 hangs down in loosely from the studs 58. The arms **54*a* of the lower yoke 54 terminate in the downward direction in angled portions 54*a*' formed with aligned holes 62. The inner sleeve 22 has an inner sidewall formed with a rectangular window 64 and an outer sidewall formed with an arcuate slot 66. The window 64 is located to permit a fabricator access to the holes 62 in the angled portions 54*a*' in the lower yoke 54 during final assembly. The lower yoke 54 is pivotable such that the holes 62 define an arc segment, which arc segment occupies a common cylindrical plane with the arcuate slot 66. The upper yoke 56 is disposed in a freely pivotable condition to extend between a pair of opposite Stop pins 68. The air spring 40, like the lower yoke 54, hangs down in loose suspension by the pin 42 through the eye loop in the end of the piston rod 44**.

To finally assemble leg assembly 12, the following steps are preferably taken. The coil tension spring 60, with an appropriate tool, is inserted through the open upper end 32 of the inner sleeve, is oriented generally vertically, and is positioned in the gap between the arms **54*a* and 56*a* of the yokes 54 and 56. Then the upper hook end of the coil spring 60 is hooked onto the bight 56*b* of the upper yoke 56. Next, the inner sleeve 22 is inserted in the outer sleeve 20 until the eye loop on the piston cylinder 46 of the air spring 40 is aligned with the appropriate holes in the foot and outer sleeve lower end 16 and 38. The three bolts or fasteners 48 are inserted in place and tightened to interconnect the foot 16, outer sleeve 20, piston cylinder 46 and cross bar 18** together.

The inner sleeve 22 is slidably positioned in the outer sleeve 20 until the window 64 aligns with the toothed opening 24 such that the holes 62 in the angled portions **54*a*' are accessible. The latch pin 28 can then be inserted and fixed in the holes 62 such that one end of the latch pin extends outwardly to occupy the plane of arcuate slot 66 while the other end extends inwardly to occupy both the planes of the window 64 in the inner sleeve 22 and the toothed opening 24 of the outer sleeve 20. To complete the assembly, the lower hook end of the coil tension spring 60 is temporarily secured by an appropriate tool and is hooked over the bight 54*b* of the lower yoke 54. FIGS. 5–7** show the resulting assembly.

The assemble of yokes 56, 54 is bistable in one of two opposite positions. FIG. 6 shows the upper yoke 56 in one of the two positions, inclined at about 1:00 o'clock relative to hinge pin 58. FIG. 7 shows the upper yoke 56 in the other position, now oriented at about 11:00 o'clock. Upper yoke 56 is limited in position between stop pins, 68 fixed in inner sleeve 22. In FIG. 6, coil spring 60 is in a given state of tension, acting to pull or pivot the lower yoke 54 counterclockwise, which urges latch pin 28 toward the ratchet slots. The latch pin 28 is shown occupying the lowermost inclined ratchet slot 26'. The latch pin 28, via the tension of the coil spring 60, is induced to follow or cam against the toothed right edge 26 of the opening 24.

If the inner sleeve 22 as shown in FIG. 6 is raised relative to outer sleeve 20, latch pin 28 follows the right edge 26 of the toothed opening 24, exiting the lowermost inclined slot 26' and then entering the next higher inclined slot. If released, the pin 28 settles into the slot and the work surface is held stable at that vertical position. The work surface and inner sleeve 22 can be adjusted in this manner relative to the stationary outer sleeve 20 to any of the discrete vertical steps defined by slots 26.

The upper limit of adjustment is reached at the uppermost inclined slot 26". From that point, further upward movement of the inner sleeve 22 results in the latch pin 28 following an upper inclined edge 72 of toothed opening 24. Contact between pin 28 and the upper inclined edge 72 causes lower yoke 54 to pivot clockwise around pivot pin 58.

When the upper and lower yokes 54 and 56 come into alignment and are diametrically opposite from pivot pin 58, the latch mechanism changes state as the spring 60 passes center and snaps the latch mechanism over to the position shown in FIG. 7. The upper yoke snaps over against the opposite stop pin 68. Ratchet pin 28 is moved away from the slots 26 toward the opposite side of the toothed opening, which does not have inclined slots.

Once the upper yoke 56 snaps over to the position shown in FIG. 7, the tension of the coil spring 60 causes latch pin 28 to remain against vertical left edge 74 of opening 24. The inner sleeve 22 can then be lowered into the outer sleeve 20, which also lowers work surface 14 relative to the floor.

In FIG. 7, latch pin 28 has been lowered to the intersection between the vertical left edge 74 and an inclined lower edge 76, which ends in the slot 26' that defines the lower limit position. Further downward movement in FIG. 7 of the inner sleeve 22 results in the latch pin 28 following the inclined lower edge 76, which induces the lower yoke 54 to pivot counterclockwise and back into the position where pin 28 engages in slots 26. As when at the upper limit, lower yoke 54 pivots into alignment with upper yoke link 56 and with further counterclockwise movement snaps over center to return the latch assembly to the relative positions shown in FIG. 6. The latch pin 28 can then occupy the lowermost slot 26' of the inclined ratchet slots 26 or can be raised to a higher one of the slots.

The latch mechanism thus cycles through vertical adjustment, disengagement and return to the lowermost position, at which the latch mechanism can again engage.

The air spring 40 responds to relative movement between the inner and outer sleeve 22 and 20 by supplying an resisting force in opposition to the applied force. Among other advantages, the air spring 40 advantageously brakes the descent of the work surface 14 when it is lowered from the uppermost release position to the lowest engaging one. Since the air spring 40 develops a resisting force proportionate to the applied force, it provides greater braking for the work surface 14 when the work surface 14 is weighted, for example with papers, books, computers and the like.

An optional arrangement of the air spring 40 may include pre-charging the air spring 40 with compressed gas such that an upward force is produced by the gas capable of supporting part of the weight of the work surface 14 and its contents.

The inner sleeve 22 has fixed to it various pins and studs 42, 58 and 68, as described above. Each of these pins and/or studs 42, 58 and 68 preferably is fixed in the inner sleeve 22 via countersinking, welding or the like to preserve a smooth exterior contour on the inner sleeve and to avoid protuberances which would interfere with the sliding of the inner sleeve 22 in the outer 20.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A vertically adjustable workstation comprising:

a pair of vertically adjustable leg assemblies, each leg assembly having a lower end terminating in a foot and an upper end terminating in a bracket, each leg assembly comprising an inner sleeve connected to the bracket and an outer sleeve which is connected to the foot and is hollow such that the inner sleeve is slidably inserted in the outer sleeve;

a work surface, attached between the brackets, for adjusting up and down relative to the feet over a limited range;

each leg assembly including an adjustment assembly which comprises the combination of a gas spring and a ratcheting latch mechanism, which gas spring has one end attached fixed relative to the foot and an opposite end attached fixed relative to the bracket; and the ratcheting latch mechanism comprising a toggle fixed relative to one of the foot and the bracket, which toggle carries a latch pin, and a member fixed relative to the other of the foot and the bracket, which member is formed with a series of ratchet slots that the latch pin can serially occupy, the ratcheting latch mechanism adjustably interconnecting the bracket with the foot such that the work surface is adjustable up in a series of discrete vertical steps and is adjustable down in one step, during which said one down step the gas spring communicates support from the foot to the work surface.

2. The vertically adjustable workstation of claim 1, wherein the toggle of the ratcheting latch mechanism is enclosed in the inner sleeve and the series of ratchet slots is formed in the outer sleeve such that the latch pin can serially occupy the ratchet slots to provide thereby vertical adjustability.

3. The vertically adjustable workstation of claim 1, wherein the gas springs are pre-charged to produce an upward force capable of supporting the work surface.

4. A vertically adjustable workstation comprising:

at least two vertically adjustable leg assemblies, each leg assembly having a lower end terminating in a supporting foot and an upper end terminating in a bracket;

a work surface attached relative to the bracket and adjustable over a limited range relative to the foot;

each leg assembly including a ratcheting latch mechanism for vertically adjusting the work surface relative to the foot; and the ratcheting latch mechanism comprising a toggle fixed relative to one of the foot and the bracket and a member fixed relative to the other of the foot and the bracket, the toggle carrying a latch pin and having an upper yoke and a lower yoke pivotally connected by a stud, and wherein the member is formed with a series of ratchet slots that the latch pin can serially occupy, whereby the work surface is adjustable upwardly in a series of discrete vertical steps and is movable downwardly in one step.

5. The vertically adjustable workstation of claim 4, wherein the member is formed with an opening that is defined by at least three edge portions which are aligned such that latch pin follows the edge portions during relative vertical movement between the foot and bracket, one edge portion being formed with the series of ratchet slots and the other two edge portions being arranged such that the toggle is first induced to snap over once and then induced to snap back, whereby the latch pin is disengaged and reengaged with the ratchet slots, respectively.

6. The vertically adjustable workstation of claim 5, wherein each leg assembly comprises an inner sleeve connected to the bracket and an outer sleeve is connected to the foot and is hollow such that the inner sleeve is slidably inserted in the outer sleeve.

7. The vertically adjustable workstation of claim 6, wherein the toggle is enclosed in the inner sleeve, and the series of ratchet slots are formed in the outer sleeve.

8. A vertically adjustable workstation comprising:

a pair of vertically adjustable leg assemblies having a foot member attached to the lower end of each leg assembly and a work surface support member attached to the upper end of each leg assembly;

a work surface attached to the work surface support members;

the work surface support members attached to the upper end of each leg assembly by a vertical adjustment assembly, each vertical adjustment assembly comprising the combination of a gas spring and a ratcheting latch mechanism;

the gas spring having one end attached to the leg assembly and the other end supporting the work surface support member with an upward force; and the ratcheting latch mechanism attached to the leg assembly and the work surface support member, the ratcheting latch mechanism comprising a toggle having an upper yoke and a lower yoke pivotally connected by a stud, the toggle fixed relative to one of the foot member and the support member, which toggle carries a latch pin, and a ratchet member fixed relative to the other of the foot member and the support member, which ratchet member is formed with a series of ratchet slots that the latch pin can serially occupy, the ratcheting latch mechanism adapted to adjust the height of the work surface support member in a series of discrete vertical steps.

9. The vertically adjustable workstation of claim 8, wherein the ratchet member is formed with an opening that is defined by at least three edge portions which are aligned such that latch pin follows the edge portions during relative vertical movement between the foot member and support member, one edge portion being formed with the series of ratchet slots and the other two edge portions being arranged such that the toggle is first induced to snap over once and then induced to snap back, whereby the latch pin is disengaged from and reengaged with, respectively, the ratchet slots.

10. The vertically adjustable workstation of claim 9, wherein the gas springs are pre-charged to produce an upward force capable of supporting the work surface.

11. A vertically adjustable workstation comprising:

a pair of vertically adjustable leg assemblies, each leg assembly having a lower end terminating in a foot and an upper end terminating in a bracket;

a work surface, attached between the brackets, for adjusting vertically relative to the feet over a limited range;

each leg assembly including an adjustment assembly comprising the combination of a gas spring and a ratcheting latch mechanism, wherein the gas spring has one end attached fixed relative to the foot and an opposite end attached fixed relative to the bracket, and wherein the ratcheting latch mechanism adjustably interconnects the bracket with the foot such that the work surface is adjustable upwardly in a series of discrete vertical steps and is adjustable downwardly in one step, during which said one downwardly step the gas spring communicates support from the foot to the work surface; and the ratcheting latch mechanism comprising a toggle including an inverted U-shaped upper yoke and a U-shaped lower yoke pivotally connected by a stud, the toggle fixed relative to one of the foot and the bracket, wherein the toggle carries a latch pin, and a member fixed relative to the other of the foot and the bracket, the member being formed with a series of ratchet slots that the latch pin can serially occupy to provide thereby vertical adjustability.

12. The vertically adjustable workstation of claim 11, wherein the member is formed with an opening that is defined by at least three edge portions which are aligned such that latch pin follows the edge portions during relative vertical movement between the foot and bracket, one edge portion being formed with the series of ratchet slots and the other two edge portions being arranged such that the toggle is first induced to snap over once and then induced to snap back, whereby the latch pin is disengaged from and reengaged with, respectively, the ratchet slots.

13. The vertically adjustable workstation of claim 12, wherein the toggle is biased by a coil tension spring positioned between opposing arm segments of the upper and lower yokes of the toggle.

* * * * *